US011612930B2

(12) United States Patent
Wöstmann et al.

(10) Patent No.: US 11,612,930 B2
(45) Date of Patent: Mar. 28, 2023

(54) CASTING MOLD FOR CASTING COMPONENTS AND METHOD FOR THE PRODUCTION THEREOF

(71) Applicant: Fraunhofer-Gesellschaft zur Förderung der angewandten Forschung e.V., Munich (DE)

(72) Inventors: Franz-Josef Wöstmann, Bremen (DE); Lukas Stumm, Bremen (DE); Christian Soltmann, Bremen (DE); Matthias Busse, Bremen (DE)

(73) Assignee: Fraunhofer-Gesellschaft zur Förderung der angewandten Forschung e.V., Munich (DE)

( * ) Notice: Subject to any disclaimer, the term of this patent is extended or adjusted under 35 U.S.C. 154(b) by 0 days.

(21) Appl. No.: 17/250,868

(22) PCT Filed: Sep. 19, 2019

(86) PCT No.: PCT/EP2019/075166
§ 371 (c)(1),
(2) Date: Mar. 16, 2021

(87) PCT Pub. No.: WO2020/058401
PCT Pub. Date: Mar. 26, 2020

(65) Prior Publication Data

US 2021/0268571 A1 Sep. 2, 2021

(30) Foreign Application Priority Data

Sep. 19, 2018 (DE) ..... 10 2018 215 966.1

(51) Int. Cl.
*B22C 9/06* (2006.01)
*B22C 9/10* (2006.01)
*B22D 17/22* (2006.01)

(52) U.S. Cl.
CPC ..... *B22C 9/061* (2013.01); *B22C 9/101* (2013.01); *B22D 17/2209* (2013.01)

(58) Field of Classification Search
CPC .. B22C 1/02; B22C 9/06; B22C 9/061; B22C 9/10; B22C 9/101; B22D 17/22; B22D 17/2209
USPC ..... 164/14, 271, 339, 340, 342, 137; 249/114.1
See application file for complete search history.

(56) References Cited

U.S. PATENT DOCUMENTS

| | | | | |
|---|---|---|---|---|
| 3,532,561 | A * | 10/1970 | Barto et al. | B22D 17/00 420/11 |
| 4,704,079 | A | 11/1987 | Pluim, Jr. | |
| 2002/0062941 | A1* | 5/2002 | Cowie et al. | B22D 17/24 164/103 |
| 2011/0132564 | A1* | 6/2011 | Merrill et al. | B22C 9/103 164/30 |
| 2011/0233378 | A1 | 9/2011 | Bales et al. | |

FOREIGN PATENT DOCUMENTS

| | | |
|---|---|---|
| CN | 101316666 | 12/2008 |
| CN | 206632339 U | 11/2017 |
| DE | 19636968 | 3/1998 |
| DE | 102004037766 | 3/2006 |
| EP | 2371469 A2 | 10/2011 |
| GB | 2208817 | 4/1989 |

OTHER PUBLICATIONS

Machine translation of DE 196 36 968 A1 (Year: 1998).*
International Application Serial No. PCT/EP2019/075166, International Search Report dated Nov. 27, 2010, w/ English Translation, (Nov. 27, 2019), 6 pgs.
International Application Serial No. PCT/EP2019/075166, Written Opinion dated Nov. 27, 2019, 5 pgs.
"Chinese Application Serial No. 201980061405.7, Office Action dated Jun. 16, 2022", w English Translation, (Jun. 16, 2022), 25 pgs.
"Chinese Application Serial No. 201980061405.7, Office Action dated Jan. 13, 2023", w English Translation, (Jan. 13, 2023), 26 pgs.

* cited by examiner

*Primary Examiner* — Kevin P Kerns
(74) *Attorney, Agent, or Firm* — Schwegman Lundberg & Woessner, P.A.

(57) ABSTRACT

Disclosed herein are systems and methods for production and use of a casting mold for casting components. The casting mold comprises at least one casting mold frame made of metal and/or of an alloy, and also one or more ceramic casting mold inserts introduced into the at least one casting mold frame. The casting mold insert(s) have the negative contour or part of the negative contour of a component to be produced or of the combination of a component to be produced with one or more casting cores.

14 Claims, No Drawings

CASTING MOLD FOR CASTING COMPONENTS AND METHOD FOR THE PRODUCTION THEREOF

PRIORITY APPLICATIONS

This application is a U.S. National Stage Filing under 35 U.S.C. § 371 from International Application No. PCT/EP2019/075166, filed on Sep. 19, 2019, and published as WO2020/058401 on Mar. 26, 2020, which claims the benefit of priority to German Application No. 10 2018 215 966.1, filed on Sep. 19, 2018; the benefit of priority of each of which is hereby claimed herein, and which applications and publication are hereby incorporated herein by reference in their entirety.

BACKGROUND

Molds can be used for fabricating cast parts. Casting molds can be made from different materials such as Urethane, Silicon, Epoxy, Plastic, or metal. The use of metal dies offers an economical process for fabricating parts. Typically, this involves use of a melting furnace, riser and die to allow a targeted solidification of the metal melt.

SUMMARY

The present invention relates to a casting mold for casting components. The casting mold comprises at least one casting mold frame made of metal and/or of an alloy, and also one or more ceramic casting mold inserts introduced into the at least one casting mold frame. The casting mold insert or the casting mold inserts has/have the negative contour or part of the negative contour of a component to be produced or of the combination of a component to be produced with one or more casting cores. The present invention also relates to a method for producing the casting mold according to the invention and to the use of the casting mold according to the invention.

DETAILED DESCRIPTION

Molding in metal permanent molds with low-pressure die casting and pressure die casting offers economical methods for fabricating cast parts. Here, the requirements on the metal casting molds or dies are high. The casting of metals that have a high melting point leads to a high thermal loading of the die, alongside the risk of welding or alloy formation at individual points between the molten material and the die. In the case of pressure die casting, additional loads result from the high pressure and speed of the melt. Due to the high tool costs, a long service life is necessary for economical fabrication. Locally overloaded regions in the molding tool may lead to premature failure.

The use of metal dies in low-pressure die casting offers an economical process for fabricating cast parts. The typical arrangement of melting furnace, riser and die allows a targeted solidification of the metal melt. In comparison to sand casting, the high cooling rates in metal dies allow for a finer-grained and dense microstructure. Due to the high tool costs, a long service life is necessary for economical fabrication. Rapid cooling and the casting of metals that have a high melting point (for example copper-containing alloys) leads to a high thermal loading of the die, alongside the risk of welding or alloy formation at individual points between the molten material and the die. The number of possible castings until the wear limit is reached is hereby reduced. The application of a sizing protects against an adhesion of the cast parts to the mold wall. However, frequent renewal of the coating leads to lower productivity.

The application of sizings may protect dies against premature wear. Sizings may be applied as a liquid or as a powder to the surface of the die. Sizings based on graphite, molybdenum disulfite or boron nitride and conventional release agents. The coatings are, in part, not very abrasion-resistant, thus resulting in the risk that defects in the coating allow a reaction between the melt and the metal of the die. Sizings may also lead to surface defects on the cast part. The transport of heat between melt and die may be disrupted by inhomogeneous coatings and may increase the amount of rejected cast parts. Previous solution strategies are based on improving coating compositions and coating methods.

Proceeding therefrom, the object of the present invention was to provide a casting mold for casting components which is less susceptible to wear and thus has a longer service life.

In accordance with the invention, a casting mold for casting components is thus described. The casting mold comprises at least one casting mold frame (or a casting mold slide) made of metal and/or of a (metal) alloy and also a ceramic casting mold insert introduced into the casting mold frame (or the casting mold slide) or a plurality of ceramic casting mold inserts introduced into the at least one casting mold frame (or the casting mold slide). The casting mold insert or the casting mold inserts has/have the negative contour or part of the negative contour of a component to be produced (with the casting mold) or the casting mold insert or the casting mold inserts has/have the negative contour or part of the negative contour of the combination of a component to be produced (with the casting mold) with one or more casting cores.

The ceramic casting mold insert or the ceramic casting mold inserts have a high resistance to wear and durability. The casting mold according to the invention is consequently less susceptible to wear and thus has a longer service life. In other words, due to the high wear resistance and durability, the number of possible castings is increased in comparison to conventional dies or casting molds.

One or more ceramic mold inserts may be introduced into a molding frame or slide made of metal and reproduce the component that is to be produced, with or without an additional core. The ceramic mold inserts may be constructed such that the use of release agents may be reduced. In addition, the material may be selected such that the component to be cast solidifies in a targeted manner. The geometry of the ceramic mold inserts may be selected such that the production is simplified to the greatest possible extent and the component achieves the desired contour optionally with the aid of cores. For rapid heat dissipation, inserts made of Si—SiC with high heat conductivity (100-160 W/mK and 4-4.8·$e^{-6}$/K WAK) or AlN (180-220 W/mK and 4.5-5.6·e−6/K WAK) may be used. A slow cooling rate may be achieved by inserts made of silicon nitride or SiAlON (4-50 W/mK and 2.1-3·e−6/K WAK). The matrix of the mold may be formed completely from the ceramic inserts or may be used only partially in particularly critical regions of the metal mold. The ceramic inserts may be used in a pressure die casting mold for regions with a slow cooling rate in order to control the solidification or in particularly heavily loaded regions in order to protect against wear.

The possibility to influence the transport of heat during the casting process may increase the quality of the cast parts. Particularly loaded regions of a metal die may be strengthened by a ceramic insert and thus used for longer. The effort associated with the application of sizings may be reduced and the productivity thus increased.

A preferred embodiment of the casting mold according to the invention is characterized in that the ceramic casting mold insert or the ceramic casting mold inserts contains/contain or consists/consist of a material or that is selected from the group consisting of AlN (aluminum nitride), SiAlON (silicon-aluminum oxide-nitride), SiN (silicon nitride), SiSiC (silicon-infiltrated silicon carbide), SiC (silicon carbide), zirconium oxide ($ZrO_2$, zirconium oxide), aluminum oxide ($Al_2O_3$), ATI (aluminum titanate) and mixtures hereof.

A further preferred embodiment is characterized in that the ceramic casting mold insert or the ceramic casting mold inserts contains/contain or consists/consist of a material that has a heat conductivity of from 1.5 to 50 W/mK and/or a coefficient of thermal expansion of from 0.5 to $3.5 \cdot e^{-6}$/K. The material of the casting mold insert or the casting mold inserts is preferably selected here from the group consisting of SiN, SiAlON, ATI (aluminum titanate) and mixtures hereof.

The heat conductivity may be determined, for example, in accordance with ASTM E1461-13. All other heat conductivities specified in this patent application may also be determined in this way.

The coefficient of thermal expansion may be determined, for example, in accordance with DIN 51045. All other coefficients of thermal expansion specified in this patent application may also be determined in this way.

A further preferred embodiment is characterized in that the ceramic casting mold insert or the ceramic casting mold inserts contains/contain or consists/consist of a material that has a heat conductivity of from 100 to 220 W/mK and/or a coefficient of thermal expansion of from 4.0 to $5.6 \cdot e^{-6}$/K. The material of the casting mold insert or the casting mold inserts is preferably selected here from the group consisting of AlN, SiSiC and mixtures hereof.

The ceramic casting mold insert or the ceramic casting mold inserts may preferably contain or consist of a material that has a heat conductivity of from 100 to 160 W/mK and/or a coefficient of thermal expansion of from 4.0 to $4.8 \cdot e^{-6}$/K, wherein the material of the casting mold insert or the casting mold inserts is preferably SiSiC, and/or contain or consist of a material that has a heat conductivity of from 180 to 220 W/mK and/or a coefficient of thermal expansion of from 4.5 to $5.6 \cdot e^{-6}$/K, wherein the material of the casting mold insert or the casting mold inserts is preferably AlN.

In accordance with a further preferred embodiment of the casting mold according to the invention, the casting mold comprises a plurality of ceramic casting mold inserts introduced into the at least one casting mold frame, which casting mold inserts have the negative contour or part of the negative contour of a component to be produced or of the combination of a component to be produced with one or more casting cores, wherein the ceramic casting mold inserts each contain or consist of a material, wherein the materials of at least two of the ceramic casting mold inserts have a different heat conductivity and/or a different coefficient of thermal expansion. This means that the material of one of the casting mold inserts has a heat conductivity and/of a coefficient of thermal expansion different from the material of at least one further of the casting mold inserts.

It is also preferred that at least one of the ceramic casting mold inserts introduced into the casting mold frame contains or consists of a material that has a heat conductivity of from 1.5 to 50 W/mK and/or a coefficient of thermal expansion of from 0.5 to $3.5 \cdot e^{-6}$/K, wherein the material is preferably selected from the group consisting of SiN, SiAlON, ATI (aluminum titanate) and mixtures hereof, and/or at least one of the ceramic casting mold inserts introduced into the casting mold frame contains or consists of a material that has a heat conductivity of from 100 to 220 W/mK and/or a coefficient of thermal expansion of from 4.0 to $5.6 \cdot e^{-6}$/K, wherein the material is preferably selected from the group consisting of AlN, SiSiC and mixtures hereof.

It is also preferred that at least one of the ceramic casting mold inserts introduced into the casting mold frame contains or consists of a material that has a heat conductivity of from 1.5 to 50 W/mK and/or a coefficient of thermal expansion of from 0.5 to $3.5 \cdot e^{-6}$/K, wherein the material is preferably selected from the group consisting of SiN, SiAlON, ATI (aluminum titanate) and mixtures hereof, and/or at least one of the ceramic casting mold inserts introduced into the casting mold frame contains or consists of a material that has a heat conductivity of from 100 to 160 W/mK and/or a coefficient of thermal expansion of from 4.0 to $4.8 \cdot e^{-6}$/K, wherein the material is preferably SiSiC, and/or at least one of the ceramic casting mold inserts introduced into the casting mold frame contains or consists of a material that has a heat conductivity of from 180 to 220 W/mK and/or a coefficient of thermal expansion of from 4.5 to $5.6 \cdot e^{-6}$/K, wherein the material is preferably AlN.

A further preferred embodiment of the casting mold according to the invention is characterized in that the ceramic casting mold insert or the ceramic casting mold inserts contains/contain or consists/consist of silicon-infiltrated silicon carbide (SiSiC).

Larger mold inserts may also be produced from SiSiC to near-net shape. Silicon carbide (SiC) is characterized by a high strength and resistance to corrosion. Mold inserts made of silicon-infiltrated SiC do not have an open porosity. SiSiC has a very high thermal conductivity which exceeds that of conventional dies made of metal. The heat conductivity is influenced here by the structure of the material (typical values are from 100 to 160 W/mk). Besides the high thermal conductivity, the coefficient of thermal expansion is low (4 to $4.8 \cdot 10^{-6}$/K). The capacity for heat conduction is increased by the infiltrated silicon. The tool insert may be used in a metal support with adapted thermal expansion and may be installed in the casting tool.

Due to the use of SiSiC as material, the effort in respect of the application of sizings is further reduced, thus increasing productivity. The good heat conductivity and the possibility to influence the thermal conductivity via the microstructure of the SiSiC may be used for shorter cycle times and controlled solidification of the melt.

It is further preferred that the ceramic casting mold insert (which contains or consists of silicon-infiltrated silicon carbide (SiSiC)) or the ceramic casting mold inserts (which contain or consist of silicon-infiltrated silicon carbide (SiSiC)) is/are provided with at least one passivation layer. The passivation layer is preferably a passivation layer selected from the material from the group consisting of carbon, silicon nitride and mixtures hereof.

In order to avoid a reaction of the silicon with the melt and to increase the chemical resistance of the tool insert, a thin layer is applied to the surface of the tool insert and covers and thus passivates the silicon regions of the surface. This layer preferably contains carbon, which at high temperature and in an inert atmosphere may form silicon carbide together with the silicon.

In accordance with a further preferred embodiment of the casting mold according to the invention, the metal (of the casting mold frame) or the alloy (of the casting mold frame) is selected from the group consisting of iron-nickel alloys, for example Invar®, iron-nickel-cobalt alloys, for example Kovar®, tool steel, cast iron, and mixtures and alloys hereof.

The casting mold according to the invention may preferably comprise a plurality of casting mold frames, for example two, three or four casting mold frames.

The casting mold insert or the casting mold inserts preferably has/have in each case a wall thickness of at least 10 mm.

The at least one casting mold frame preferably has in each case a wall thickness of at least 25 mm.

The at least one casting mold frame preferably has channels for controlling the temperature of the at least one casting mold frame and/or of the casting mold insert or the casting mold inserts.

The at least one casting mold frame is preferably mounted on a carrier plate, preferably a carrier plate made of tool steel. Further components may be attached to the carrier plate (such as a coupling plate for closing cylinders, an ejector, etc.).

The present invention also relates to a method for producing a casting mold according to the invention, in which a casting mold insert or a plurality of casting mold inserts which has/have the negative contour or part of the negative contour of a component to be produced or of the combination of a component to be produced with one or more casting cores, is/are introduced or used in at least one casting mold frame made of metal or of a (metal) alloy.

A preferred variant of the method according to the invention is characterized in that the ceramic casting mold insert or the ceramic casting mold inserts contains/contain or consists/consist of silicon-infiltrated silicon carbide (SiSiC).

Here, it is preferred that the ceramic casting mold insert or the ceramic casting mold inserts is/are provided with at least one passivation layer, wherein the passivation layer is preferably a passivation layer selected from a material from the group consisting of carbon, silicon nitride and mixtures hereof.

It is furthermore preferred that the ceramic casting mold insert or the ceramic casting mold inserts is/are provided with the at least one passivation layer in that, firstly, at least one layer with the material of the passivation layer is applied to the ceramic casting mold insert or the ceramic casting mold inserts and then the at least one applied layer is subjected to a temperature treatment, preferably in an inert gas atmosphere, particularly preferably a nitrogen gas atmosphere, wherein the temperature treatment is preferably performed at a temperature in a range of from 1000° C. to 1400° C. and/or for a duration of from 12 h to 120 h.

The present invention additionally relates to the use of a casting mold according to the invention in a method for casting one or more components, wherein the method is preferably a low-pressure die casting method.

On the basis of the following examples, the present invention will be explained in more detail without wishing to restrict it to the specific embodiments and parameters shown here.

Exemplary Embodiment

A casting mold for low-pressure die casting, consisting of two mold parts, is constructed as follows: Each mold half consists of a casting mold frame, in which there is inserted a casting mold insert made of aluminum nitride. The appropriate negative component contour is formed in the upper side of the casting mold insert, wherein the further design of the mold inserts is suitable for ceramics, in particular in respect of a minimization of stresses occurring as a result of cyclical thermal stress. The minimum wall thickness of the mold insert is 10 mm. The underside and the side faces of the casting mold insert are surrounded by a casting mold frame which is fabricated from an iron-nickel-cobalt alloy (Fe54Ni29Co17). The mold frame is shaped such that planar contact with the underside and the side faces of the ceramic mold insert is possible. The casting mold frame has a minimum wall thickness of 25 mm and is provided with channels for controlling the temperature of the casting mold frame and the mold insert. The casting mold frame is mounted on a carrier plate made of tool steel, to which further components are attached (for example coupling plate for closing cylinders, ejectors, etc.). The mold halves are guided on a base plate made of tool steel for opening and closing. A sleeve made of aluminum titanate that is conical on the inner side is inserted into the base plate for the transition from the riser into the closed mold. The casting mold is temperature-controlled via the casting mold frame by an oil temperature-control system, wherein the maximum temperature at the casting mold frame does not exceed 350° C. The described casting mold is used for lightweight metal casting up to 800° C.

The invention claimed is:

1. A casting mold for casting components, the casting mold comprising;

at least one casting mold frame made of a metal or of an alloy; and multiple ceramic casting mold inserts which are configured to be introduced into the at least one casting mold frame and which comprise a negative contour or a part of the negative contour of a component to be produced, or of a combination of a component to be produced with at least one casting core;

wherein the multiple ceramic casting mold inserts are introduced into the at least one casting mold frame, wherein the multiple casting mold inserts comprise the negative contour or the part of the negative contour of the component to be produced or of the combination of a component to be produced with the at least one casting core, wherein the ceramic casting mold inserts each include a material, and wherein a first material of a particular one of the ceramic casting mold inserts has a material characteristic property that includes at least one of a heat conductivity different from a second material of at least a second particular one of the ceramic casting mold inserts, a coefficient of thermal expansion different from the second material of the second particular one of the ceramic casting mold inserts, or a heat conductivity and a coefficient of thermal expansion different from the second material of the second particular one of the ceramic casting mold inserts.

2. The casting mold according to claim 1, wherein the multiple ceramic casting mold inserts include a material that is at least one of: AlN, SiAlON, SiN, SiSiC, SiC, zirconium oxide, aluminum oxide, aluminum titanate, or a mixture thereof.

3. The casting mold according to claim 1, wherein the multiple ceramic casting mold inserts include a material that has a heat conductivity of from 1.5 to 50 W/mK, inclusive.

4. The casting mold according to claim 3, wherein the material has a coefficient of thermal expansion of from 0.5 to $3.5 \cdot e^{-6}$/K, inclusive.

5. The casting mold according to claim 3, wherein the material is at least one of: SiN, SiAlON, aluminum titanate, or a mixture thereof.

6. The casting mold according to claim 1, wherein the multiple ceramic casting mold inserts include a material that has a heat conductivity between 100 and 220 W/mK, inclusive.

7. The casting mold according to claim 6, wherein the material has a coefficient of thermal expansion between 4.0 to $5.6 \cdot e^{-6}$/K, inclusive, and wherein the material is at least one of: AlN, SiSiC, or a mixture thereof.

8. The casting mold according to claim 1, wherein at least one of the ceramic casting mold inserts introduced into the casting mold frame includes a material that has at least one of:

a heat conductivity between 1.5 and 50 W/mK, inclusive, or a coefficient of thermal expansion between 0.5 and $3.5 \cdot e^{-6}$/K, inclusive, and wherein the material is at least one of: SiN, SiAlON, aluminum titanate or a mixture thereof.

9. The casting mold according to claim 1, wherein the multiple ceramic casting mold inserts include silicon-infiltrated silicon carbide (SiSiC).

10. The casting mold according to claim 9, wherein the multiple ceramic casting mold inserts include at least one passivation layer, the at least one passivation layer including a material, and wherein the material is at least one of: carbon, silicon nitride, or a mixture thereof.

11. The casting mold according to claim 1, wherein the metal or the alloy is at least one of: an iron-nickel alloy, an iron-nickel-cobalt alloy, tool steel, cast iron, and mixtures or alloys thereof.

12. The casting mold according to claim 1, wherein at least one of the casting mold inserts introduced into the at least one casting mold frame includes a material that has at least one of: a heat conductivity between 100 and 220 W/mK, inclusive, or a coefficient of thermal expansion between 4.0 and $5.6 \cdot e^{-6}$/K, inclusive, and wherein the material is at least one of: AlN, SiSiC, or a mixture thereof.

13. A casting mold for casting components, the casting mold comprising:

a casting mold frame made of at least one of a metal or an alloy; and a set of ceramic casting mold inserts configured to be introduced into the casting mold frame, wherein each of the ceramic casting mold inserts comprises:

a negative contour, or a part of the negative contour, of a component or a combination of a component to be produced with a casting core;

wherein each of the ceramic casting mold inserts is introduced into the casting mold frame, wherein each of the ceramic casting mold inserts comprise the negative contour or the part of the negative contour of the component to be produced with the casting core, wherein a particular ceramic mold insert of the set of the ceramic casting mold inserts includes a first material, wherein a second particular ceramic mold insert of the set of ceramic casting mold inserts includes a second material different from the first material, and wherein the first material has a material characteristic property that includes at least one of a heat conductivity different from the second material, a coefficient of thermal expansion different from the second material, or a heat conductivity and a coefficient of thermal expansion different from the second material, and wherein either the first material or the second material has a heat conductivity of between 1.5 and 50 W/mK, inclusive, and wherein the material is at least one of: SiN, SiAlON, aluminum titanate, or a mixture thereof.

14. The casting mold of claim 13, further comprising:

a second casting mold insert configured to be introduced into the casting mold frame, wherein the second casting mold insert includes a second material, and wherein the second material has at least one of: a different heat conductivity or a different coefficient of thermal expansion than the material of a first casting mold insert.

* * * * *